United States Patent [19]

van Leeuwen et al.

[11] 3,973,161

[45] Aug. 3, 1976

[54] PLURAL GUN CATHODE-RAY TUBE WITH OVAL CONTROL ELECTRODES

[75] Inventors: Johannes Aloysius van Leeuwen; Antonius Wilhelmus Franciscus van der Heijden, both of Eindhoven, Netherlands

[73] Assignee: U. S. Philips Corporation, New York, N.Y.

[22] Filed: Feb. 10, 1975

[21] Appl. No.: 548,529

[30] Foreign Application Priority Data

Feb. 22, 1974 Netherlands ..... 7402421

[52] U.S. Cl. ..... 313/409; 313/447

[51] Int. Cl.[2] ..... H01J 29/02; H01J 29/50

[58] Field of Search ..... 313/446, 409, 411, 412, 313/413, 444, 447, 448, 417, 414

[56] References Cited

UNITED STATES PATENTS

| | | | |
|---|---|---|---|
| 3,065,376 | 11/1962 | Atti | 313/409 X |
| 3,354,340 | 11/1967 | Almer et al. | 313/447 |
| 3,793,551 | 2/1974 | Gumpertz | 313/411 |

*Primary Examiner*—Robert Segal

*Attorney, Agent, or Firm*—Frank R. Trifari; George B. Berka

[57] ABSTRACT

In a color cathode-ray tube, the neck of the tube comprises an assembly of three electron guns lying in one plane. The size of the assembly is reduced by using oval control electrodes the longer axes of which are perpendicular to the plane through the electron guns.

6 Claims, 5 Drawing Figures

PLURAL GUN CATHODE-RAY TUBE WITH OVAL CONTROL ELECTRODES

Figure 1:
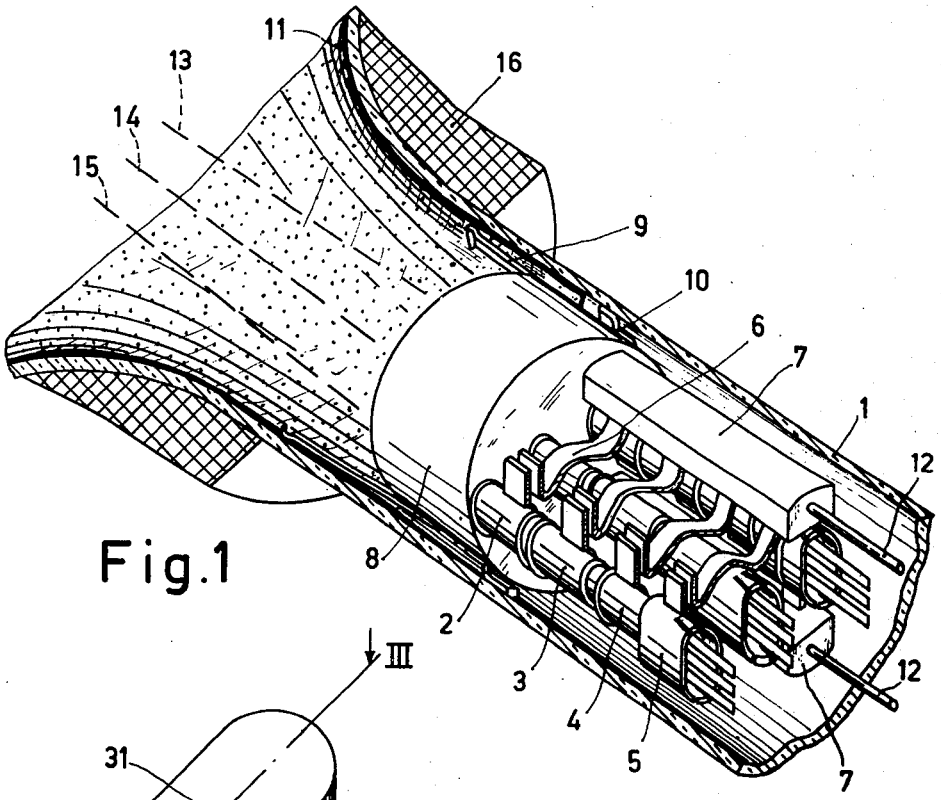

The invention relates to a cathode-ray tube for displaying coloured pictures and comprising in a neck forming part of the evacuated envelope of the tube means to generate three electron beams the axes of which are initially located in one plane through the longitudinal axis of the tube, which means comprise, for generating each electron beam, a cathode-control electrode combination which is mainly constructed from a cylindrical cathode body which is mounted inside a first supporting sleeve which surrounds the cathode coaxially, which first supporting sleeve is accommodated inside a second supporting sleeve and is secured thereto by means of an electrically insulating material, which second supporting sleeve in turn is surrounded by a perforated beaker-like control electrode.

Cathode-ray tubes of the above-mentioned type are known. The means for generating the electron beams may consist of three individual electron guns or of three electron guns of which certain corresponding electrodes have an integrated construction.

Although such an in-line arrangement of the electron guns have advantages, in particular with respect to the convergence of the electron beams, as compared with the so far frequently used arrangement in which the guns are placed at the corners of an equilateral triangle, the first-mentioned arrangement is less suitable to obtain a compact assembly of the electron guns. The requirement of compact assemblies, however, becomes the more prominent according as the demand for smaller display tubes sizes increases. Furthermore it is endeavoured to minimize the energy which is necessary to deflect the electron beams. As is known, the electron beams are deflected by means of magnetic fields produced by a system of cores arranged coaxially around the tube axis. The influence of said magnetic fields on the electron beams can be increased by giving the neck in which the electron guns are arranged a diameter which is as small as possible. Consequently, the electron guns should be assembled to form a compact assembly so as to be able to accommodate the resulting assembly in the neck of the tube. A reduction to scale of existing gun constructions seems the obvious way in the first instance to arrive at a solution to said problem, but this introduces other problems, notably of a technological nature. For example, it will be obvious that the admissibility for tools which are necessary upon assembling an electron gun is seriously restricted, if not made impossible, by the small dimensions of the composing elements of the gun. In this respect is to be considered notably the cathode-control electrode combination of a gun. For the assembly thereof, certain welding operations are necessary and sufficient space should be available to provide the welding electrodes. Another reason why radial changes in the construction of said parts of the gun are preferably avoided is that the solution to numerous problems occurring in said part of the gun is usually based on years of intensive development, developments which have resulted in cathode constructions of substantially identical properties, which is an implicit requirement for composing guns as described above.

It is the object of the invention to provide an assembly of three electron guns which lie in one plane and which can easily be accommodated in a neck of a small inside diameter.

According to the invention, in a cathode-ray tube of the kind mentioned in the first paragraph in which the cathode is mounted inside a first supporting sleeve which surrounds the cathode coaxially, which first supporting sleeve is accommodated inside a second supporting sleeve and is secured thereto by means of an electrically insulating material, which second supporting sleeve in turn is surrounded by a perforated beaker-like control electrode, at least the second supporting sleeve has in cross-section an oblong shape the length axis of which is perpendicular to the plane through the electron beams and the axis of the tube.

A great advantage of the invention is that the dimension of the total electrode system is considerably reduced in one direction without radical changes having been made in the construction of the cathode-control electrode combination as such. Thus sufficient space remains available to carry out certain operations, while furthermore certain favourable structural shapes for a cathode-control electrode combination can be maintained. Such a favourable structural shape is described, for example, in the U.S. Pat. No. 3,354,340. In this Patent Specification two supporting members for the heating wire arranged inside the cathode-body are connected in the electrically insulating material between the first and the second supporting sleeve. The second supporting sleeve fits in a beaker-like control electrode with a slight amount of play and is welded to said control electrode after the required distance between cathode and control electrode has been adjusted. The supporting members for the heating wire ensure an accurately fixed position thereof with respect to the cathode and prevent that said position changes only to the smallest extent during the further assembly of the gun. With further measures, such as a black cathode shaft with small heat capacity, the construction is extremely suitable to obtain a rapid heating time of the cathode, while furthermore the properties of combinations thus formed are mutually substantially identical. All this makes such a cathode-control electrode combination consequently extremely suitable for use in a cathode-ray tube of the kind as described in the first paragraph. According to the invention, the supporting members for the heating wire arranged inside the cathode are secured near the ends of the length axis of the oblong second supporting sleeve in the electrically insulating material between the second supporting sleeve and the first supporting sleeve.

According to the invention, the beaker-like control electrode and the said second supporting sleeve cooperate in a self-centering manner so as to facilitate the assembling together thereof. For that purpose, the superficies of the said second supporting sleeve is preferably bent inwardly at a rounded angle at its end facing the end face of the control electrode.

In the superficies of the control electrode lugs are recessed at the area where said electrode is secured to the said second supporting sleeve by spot welding. Said lugs are present in a place which is admissible for the welding electrodes and preferably diametrically opposite to each other at or near the ends of the length axis of the oblong control electrode. Since two stiff a spring action of the lugs can prevent that during welding they make good contact with the supporting sleeve, according to the invention said lugs are narrowed in the direction in which they merge into the superficies of the control electrode.

The invention will be explained in greater detail with reference to the drawing, in which:

FIG. 1 is a perspective view of an assembly of three electron guns according to the invention in a neck of a cathode-ray tube which is partly broken away.

Figure 2:
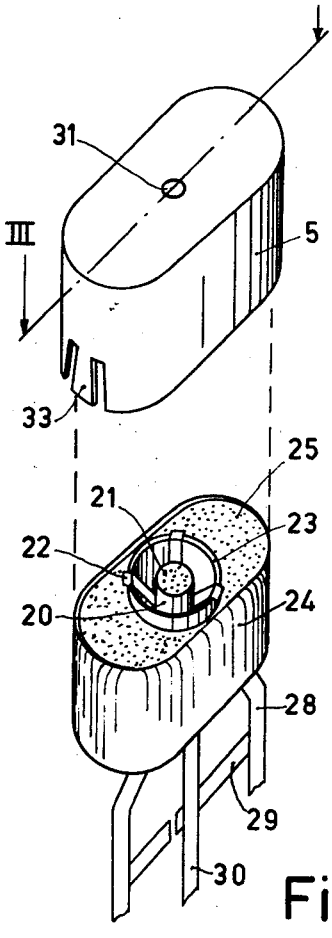
Figure 3:
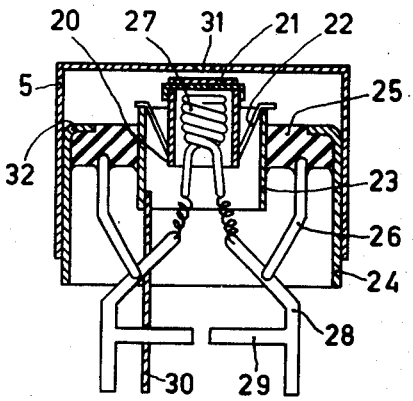
Figure 4:
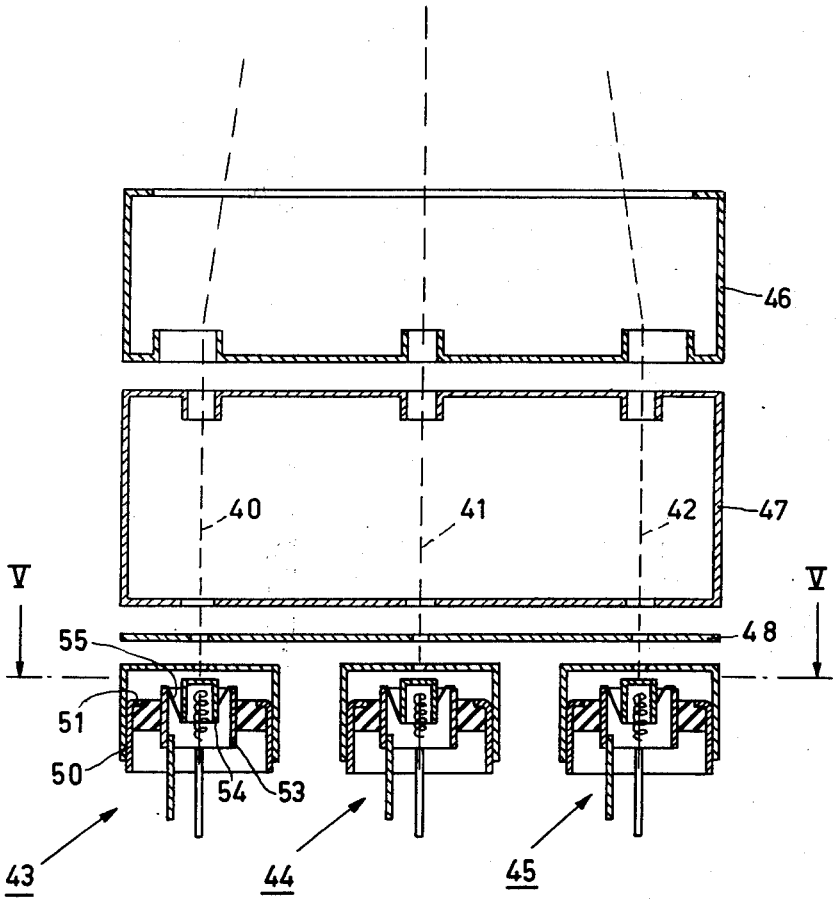
Figure 5:
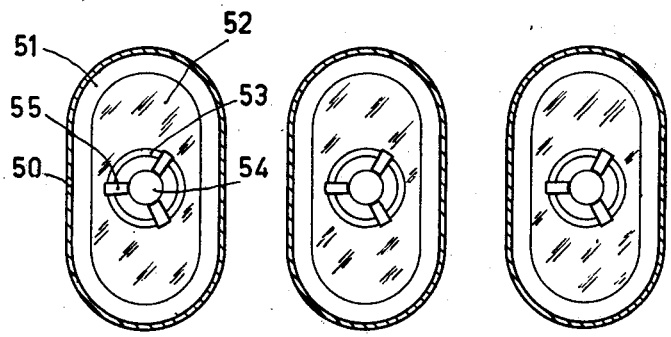

FIG. 2 is an exploded view of a cathode-control electrode combination of one of the electron guns of the assembly shown in FIG. 1, FIG. 3 is a longitudinal sectional view of the combination shown in FIG. 2 and taken on the line III—III, FIG. 4 is a longitudinal sectional view of another embodiment of a system of three electron guns according to the invention, and FIG. 5 is a cross-sectional view taken on the line V-V of the assembly shown in FIG. 4.

FIG. 1 shows only the neck portion of a cathode-ray tube according to the invention. The neck 1 has an inside diameter of 24 mm and comprises an assembly of three electron guns lying in one plane. Each electron gun comprises, centered along an axis, an acceleration electrode 2, a focusing electrode 3, an anode 4 and a cathode-control electrode combination of which only the control electrode 5 is visible in the drawing. Each electrode has connection members 6 the free ends of which are sealed in four glass rods 7 two of which are shown in the drawing. A centering cylinder 8 having two contact springs 9 and three centering springs 10 is mounted on the acceleration electrodes 2. The contact springs 9 contact an electrically conductive layer 11 provided internally on the tube wall. The centering springs 10 position the assembly in the neck and also serve as damping springs to avoid microphony. The glass rods 7 have pins 12 to secure the assembly of guns in the neck 1, namely to the closing plate thereof, in which the leadthrough pins for the electric connection of the electrodes are also provided. With the exception of the cathode-control electrode combination, the cathode-ray tube, which is otherwise of the known type, is provided with a shadow mask. As is known, said shadow mask is mounted at a short distance from a target in the tube. The target is covered with a mosaic pattern of phosphors luminescing in the colours red, green and blue. The two outermost guns enclose such an angle with the central gun that the axes of the three electron beams 13, 14 and 15 intersect each other at the area of the target. Thus, after passing through the mask, each beam is associated with phosphor regions of one colour. A system 16 of deflection coils placed coaxially around the tube axis and shown diagrammatically in the drawing ensures the deflection of the electron guns in two mutually perpendicular directions.

In order to be able to accommodate the assembly of 9.6guns in a neck of a small inside diameter, the cathode control electrode combination which is shown in detail in FIGS. 2 and 3 of each gun has an oval shape the long axis of which is at right angles to the plane through the three electron guns. The combination consists of a beaker-like cathode 20 the end face of which is covered with an electron-emissive layer 21. The cathode 20 is secured to a first metal supporting sleeve 23 by means of three supporting members 22. A second metal supporting sleeve 24 surrounds the supporting sleeve 23 and is secured thereto by means of a ceramic ring 25. The supporting sleeve 24 has an oval shape with a long axis of 9.6 mm and a short axis of 6.8 mm. In the ceramic material of the ring near the ends of the long axis of the supporting sleeve 24, so in the wide portions of the ring 25, two supporting members 26 are sealed. The ends of a filament wire 27 arranged inside the cathode 20 are connected by means of a connection brace 28 the transverse connection 29 of which is interrupted after the brace 28 has been welded to the supporting members 26. Via a current supply conductor 30 which is secured to the supporting sleeve 23, the cathode 20 can be brought at the desired potential relative to the oval control electrode 25 the end face of which has a central aperture 31. The control electrode 5 fits over the supporting sleeve 24 with a slight amount of play. In order to facilitate the assembly of control electrode and supporting sleeve, the end of the supporting sleeve is bent inwardly at a rounded angle as denoted at 32, so that the supporting sleeve and the control electrode cooperates in a self centering manner during the assembly. After adjusting the desired distance between the control electrode 5 and the cathode 20, the control electrode is spot-welded to the supporting sleeve 24. At the area of said spot welds, resilient lugs 33 are recessed in the superficies of the control electrode. For practical reasons, in connection with the space required for the welding poles, the lugs are recessed in the strongly curved parts of the control electrode. In order to obtain a greater flexibility in the resilience, the lugs are narrowed in the direction where they merge into the superficies of the control electrode.

The system of electron guns shown in FIG. 4 generates three electron beams 40, 41 and 42 lying in the plane of the drawing. The system comprises three individual oval cathode-control grid combinations 43, 44 and 45 the long axis of which is perpendicular to the plane of the drawing. Otherwise the combinations are entirely analogous to those shown in FIG. 2 and FIG. 3. The system comprises an integral acceleration electrode 46, an integral focusing electrode 47 and an integral anode 48. The apertures in electrode 46 are placed slightly eccentric in known manner relative to the apertures in electrode 47 so as to obtain convergence of the electron beams 40, 41 and 42.

FIG. 5 is a cross-sectional view taken on the line V'V of the system shown in FIG. 4. Shown are in cross-section the control electrode 50 and in plan view the second supporting sleeve 51, the ceramic ring 52, the first supporting sleeve 53 and the cathode 54 which is secured to the first supporting sleeve by means of the suspension members 55.

What is claimed is:

1. A cathode-ray tube for displaying color pictures having, in the neck portion of its envelope, means to generate a plurality of electron beams located in a single plane passing through the longitudinal axis of the tube, said means comprising, for each electron beam, a substantially cylindrical cathode body, a first conductive sleeve coaxially surrounding said cathode body and being connected thereto, a second conductive sleeve surrounding said first sleeve and being secured thereto by an electrically insulating member, and an outer, beaker-like control electrode surrounding said second sleeve and being in contact therewith, said second sleeve and said control electrode having respectively, an oblong cross-section the longer axis of which is perpendicular to said single plane.

2. A cathode-ray tube as claimed in claim 1, further comprising additional supporting members connected to the heating wire within said cathode body, said supporting members having end portions embedded within said insulating member near the ends of the longer axis of said second sleeve.

3. A cathode-ray tube as claimed in claim 1, wherein said control electrode is secured to said second sleeve by spot-welding.

4. A cathode-ray tube as claimed in claim 1, wherein said first sleeve is connected to said cathode body by conductive supporting members.

5. A cathode-ray tube as claimed in claim 1, wherein the superficies of the oblong second sleeve is bent inwardly at a rounded angle at its end facing the end face of the beaker-like control electrode.

6. A cathode-ray tube as claimed in claim 5, in which lugs are recessed in the superficies of the control electrode at the area where it is secured to the said second supporting sleeve said lugs being placed substantially diametrically opposite to each other and narrowed in the direction in which they merge into the superficies of the control electrode.

* * * * *

UNITED STATES PATENT AND TRADEMARK OFFICE

CERTIFICATE OF CORRECTION

PATENT NO. : 3,973,161

DATED : August 3, 1976

INVENTOR(S) : JOHANNES A. VAN LEEUWEN ET AL

It is certified that error appears in the above-identified patent and that said Letters Patent are hereby corrected as shown below:

Column 3, line 55, change "9.6" to --three--.

Signed and Sealed this

Twelfth Day of October 1976

[SEAL]

*Attest:*

RUTH C. MASON
*Attesting Officer*

C. MARSHALL DANN
*Commissioner of Patents and Trademarks*